US009519249B2

(12) United States Patent
Hirose et al.

(10) Patent No.: US 9,519,249 B2
(45) Date of Patent: Dec. 13, 2016

(54) FIXING DEVICE AND IMAGE FORMING APPARATUS

(71) Applicants: Fumihiro Hirose, Kanagawa (JP); Masami Okamoto, Kanagawa (JP); Kenji Nozawa, Kanagawa (JP); Yuuki Kikushima, Kanagawa (JP); Kensuke Yamaji, Kanagawa (JP); Keisuke Kubota, Kanagawa (JP); Shuutaroh Yuasa, Kanagawa (JP); Kaori Hemmi, Kanagawa (JP)

(72) Inventors: Fumihiro Hirose, Kanagawa (JP); Masami Okamoto, Kanagawa (JP); Kenji Nozawa, Kanagawa (JP); Yuuki Kikushima, Kanagawa (JP); Kensuke Yamaji, Kanagawa (JP); Keisuke Kubota, Kanagawa (JP); Shuutaroh Yuasa, Kanagawa (JP); Kaori Hemmi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/968,512

(22) Filed: Dec. 14, 2015

(65) Prior Publication Data

US 2016/0170350 A1 Jun. 16, 2016

(30) Foreign Application Priority Data

Dec. 12, 2014 (JP) ..... 2014-251702
Dec. 4, 2015 (JP) ..... 2015-237385

(51) Int. Cl.
*G03G 15/20* (2006.01)

(52) U.S. Cl.
CPC ..... *G03G 15/2053* (2013.01); *G03G 15/2017* (2013.01); *G03G 2215/2032* (2013.01)

(58) Field of Classification Search
CPC ..... G03G 15/2007; G03G 15/2017; G03G 15/2053; G03G 2215/2016; G03G 2215/2019; G03G 2215/2032
(Continued)

(56) References Cited

U.S. PATENT DOCUMENTS

2008/0013995 A1 1/2008 Kubota et al.
2009/0116884 A1 5/2009 Nonaka et al.
(Continued)

FOREIGN PATENT DOCUMENTS

EP 2 610 688 A1 7/2013
JP 63-92367 U 6/1988
(Continued)

OTHER PUBLICATIONS

Machine translation of JP 2007-310244 A (publication date of Nov. 29, 2007) printed on Apr. 22, 2016.*
(Continued)

*Primary Examiner* — Sophia S Chen
(74) *Attorney, Agent, or Firm* — Oblon, McClelland, Maier & Neustadt, L.L.P.

(57) ABSTRACT

A fixing device includes a cylindrical heat roller; a plurality of heaters disposed inside the heat roller, extending along a longitudinal axis of the heat roller; and a heat adjuster, disposed among the plurality of heaters, to adjust heat from one to another of the plurality of heaters. An image forming apparatus includes an image forming section to form an image on a recording medium; and the fixing device as described above, to fix the image onto the recording medium.

20 Claims, 4 Drawing Sheets

(58) Field of Classification Search
USPC ..... 399/328, 329, 330, 336
See application file for complete search history.

(56) References Cited

U.S. PATENT DOCUMENTS

| | | | | |
|---|---|---|---|---|
| 2009/0274497 | A1* | 11/2009 | Okamoto | G03G 15/2025 399/329 X |
| 2011/0020018 | A1 | 1/2011 | Takenaka et al. | |
| 2011/0206425 | A1 | 8/2011 | Seto et al. | |
| 2011/0222891 | A1 | 9/2011 | Kagami | |
| 2012/0087688 | A1 | 4/2012 | Kubota | |
| 2012/0288308 | A1 | 11/2012 | Kobashigawa | |
| 2013/0170879 | A1* | 7/2013 | Yoshinaga | G03G 15/2053 399/329 |
| 2013/0243465 | A1* | 9/2013 | Honda | G03G 15/2053 399/328 X |
| 2014/0086650 | A1* | 3/2014 | Ebe | G03G 15/2053 399/329 |
| 2014/0169820 | A1 | 6/2014 | Kusumoto | |

FOREIGN PATENT DOCUMENTS

| | | |
|---|---|---|
| JP | 4-212982 | 8/1992 |
| JP | 8-234605 | 9/1996 |
| JP | 8-314326 | 11/1996 |
| JP | 2002-022430 | 1/2002 |
| JP | 2002-031974 | 1/2002 |
| JP | 2002-72736 A | 3/2002 |
| JP | 2005-202202 | 7/2005 |
| JP | 2007-286163 | 11/2007 |
| JP | 2007-310244 | 11/2007 |
| JP | 2008-040442 | 2/2008 |
| JP | 2009-115969 | 5/2009 |
| JP | 2011-022430 | 2/2011 |
| JP | 2011-175162 | 9/2011 |
| JP | 2011-191569 | 9/2011 |
| JP | 2011-237831 A | 11/2011 |
| JP | 2012-083454 | 4/2012 |
| JP | 2012-145720 | 8/2012 |
| JP | 2012-234105 | 11/2012 |
| JP | 2014-021211 | 2/2014 |

OTHER PUBLICATIONS

Extended European Search Report issued Apr. 15, 2016 in Patent Application No. 15199905.9.

* cited by examiner

FIXING DEVICE AND IMAGE FORMING APPARATUS

CROSS-REFERENCE TO RELATED APPLICATION

The present application claims priority pursuant to 35 U.S.C. §119(a) from Japanese patent application number 2014-251702, filed on Dec. 12. 2014, and Japanese patent application number 2015-237385, filed Dec. 4, 2015,the entire disclosures of which is incorporated by reference herein.

BACKGROUND

Technical Field

The present invention relates to a fixing device and an image forming apparatus including the same.

Background Art

In a fixing device employed in an image forming apparatus, a heat roller fixing system or belt fixing system is one way to fix a toner image to a recording medium such as a sheet of paper or the like.

In the heat roller fixing system, a fixing roller incorporating a heating device, such as an infrared heater, and a pressure roller that presses against the fixing roller form a nip portion, the recording medium carrying an unfixed toner image thereon is sandwiched by and conveyed through the nip portion, is heated and pressed, and the unfixed toner image is fixed onto the recording medium.

In the belt fixing system, an endless fixing belt is stretched around the heat roller that incorporates the infrared heater, and the fixing roller; a nip portion is formed by a pressure roller and the fixing belt; and the recording medium carrying an unfixed toner image is sandwiched and conveyed in the nip portion and is heated and pressed, to thereby fix the unfixed toner image thereon.

SUMMARY

In one embodiment of the disclosure, provided is an optimal fixing device including a cylindrical heat roller; a plurality of heaters disposed inside the heat roller, extending along a longitudinal axis of the heat roller; and a heat adjuster, disposed among the plurality of heaters, to adjust heat from one to another of the plurality of heaters.

In another embodiment of the disclosure, provided is an image forming apparatus including an image forming section to form an image on a recording medium; and the fixing device as described above, to fix the image onto the recording medium.

These and other objects, features, and advantages of the present invention will become apparent upon consideration of the following description of the preferred embodiments of the present invention when taken in conjunction with the accompanying drawings.

DETAILED DESCRIPTION (First Embodiment)

A fixing device 1 according to a first embodiment of the present invention will be described with reference to FIGS. 1 to 4.

Figure 1:
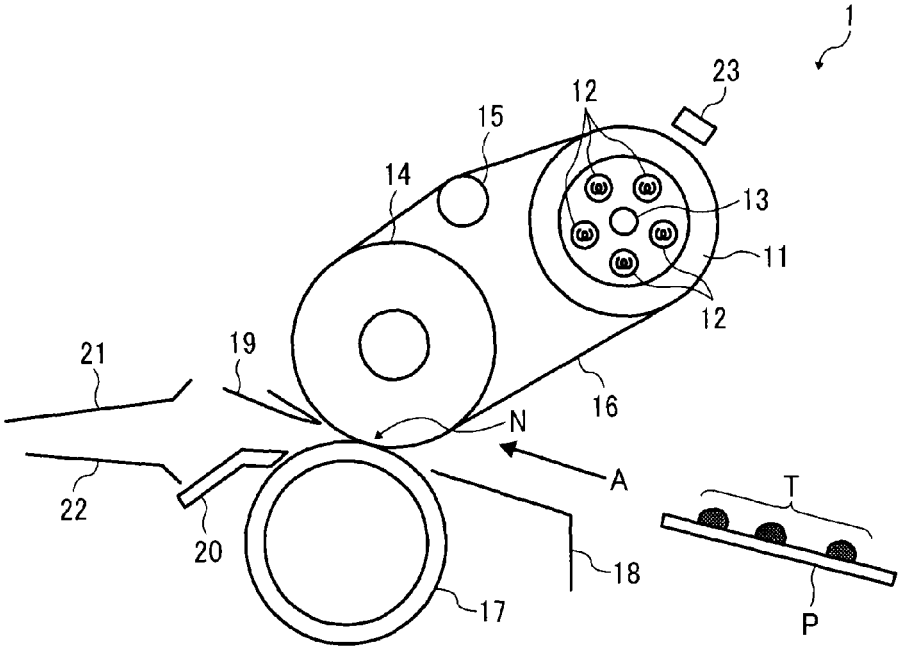
FIG. 1 schematically illustrates a fixing device according to a first embodiment of the present invention.

FIG. 1 is a general configuration of the fixing device 1. As illustrated in FIG. 1, the fixing device 1 includes a heat roller 11, a plurality of infrared heaters 12 (which may be collectively referred to as the infrared heater 12), a heat adjuster 13, a fixing roller 14, a tension roller 15, a fixing belt 16, a pressure roller 17, an inlet guide 18, a separation plate 19, a stripper finger 20, an upper outlet guide 21, a lower outlet guide 22, and a temperature sensor 23.

The heat roller 11 serves to heat the fixing roller 14. The heat roller 11 is a cylindrical, hollow roller formed of aluminum or iron. The heat roller 11 and the fixing roller 14 are disposed opposite with a space therebetween, such that each axis thereof is parallel to the other. A plurality of infrared heaters 12 and the heat adjuster 13 are disposed inside the heat roller 11. Thus, the heat roller 11 serves as a rotatable cylindrical heating device, and accommodates heating means (here, the infrared heaters 12) and the heat adjuster 13 therein.

Figure 2:
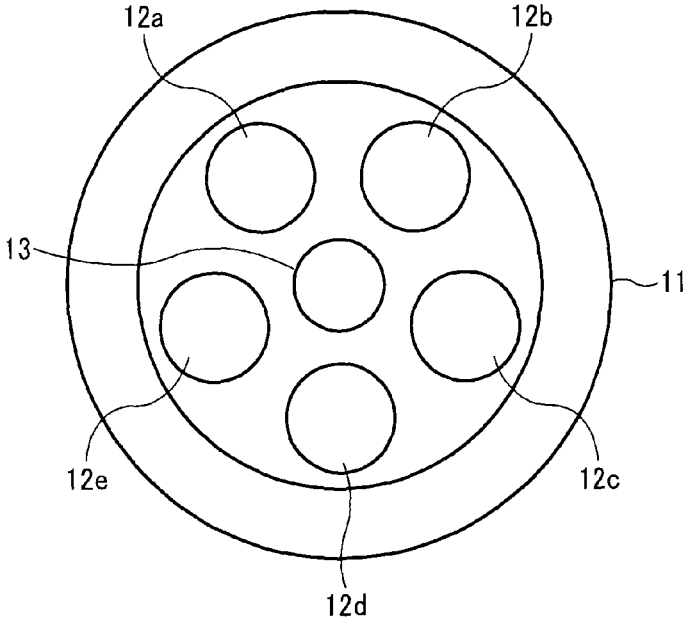
FIG. 2 is an enlarged view of a heat roller including a heat adjuster as illustrated in FIG. 1.

FIG. 2 is an enlarged view of the heat roller 11. As illustrated in FIG. 2, a total of five infrared heaters 12*a*, 12*b*, 12*c*, 12*d*, and 12*e*, referred to collectively as the infrared heater 12, are disposed inside the heat roller 11. The heat adjuster 13 is disposed inside the heat roller 11.

The infrared heater 12 is a known heating device, has a cylindrical shape, and is formed to extend along the longitudinal axis of the heat roller 11. The five infrared heaters 12*a*, 12*b*, 12*c*, 12*d*, and 12*e* are disposed around an internal circumference of the heat roller 11, that is, in a predetermined circle, such that adjacent heaters are disposed with an equal interval between adjacent heaters when viewed in cross-section. The number of infrared heaters 12 is five in the present embodiment; however, the number of heaters is not limited to five although number cannot be less than 2, so long as all infrared heaters can be disposed inside the heat roller 11.

In addition, the infrared heater 12 is used as a heating device in the present embodiment; however, alternatively, a halogen heater or any other heating device may be used. Further, the heating device is not limited to the cylindrical shape, but may be a rectangular shape in cross-section. In short, so long as the heating device is disposed to extend along the longitudinal axis of the heat roller 11, the shape is not limited in particular.

The heat adjuster 13 is made of glass, has a cylindrical shape, and extends in the longitudinal axis of the heat roller 11. Specifically, the heat adjuster 13 is a hollow tube. Air or a gas such as nitrogen is sealed inside the tube. The heat adjuster 13 is disposed at an internal central portion of the beat roller 11. More specifically, the heat adjuster 13 is disposed equidistant from each of the infrared heaters 12*a*, 12*b*, 12*e*, 12*d*, and 12*e*.

Lateral ends of each of the infrared heaters 12 and the heat adjuster 13 are secured to, for example, a metal plate. The both lateral ends or one end of the infrared heater 12 are connected to a power line and the electricity is supplied to the infrared heater 12.

The heat adjuster 13, being a non-heat generating member, does not itself generate heat, but instead absorbs the heat the infrared heater 12 disposed therearound generates. Then, the heat absorbed by the heat adjuster 13 is cooled/discharged by thermal conduction from both lateral ends. As a result, for example, the infrared heater 12*a* may be directly heated by adjacent infrared heaters 12*b* and 12*e*: however, direct heat to the infrared heater 12*a* from the infrared heaters 12*c* and 12*d* disposed opposite with the heat adjuster 13 sandwiched in between, can be reduced. As a result, possibility to exceed the rated temperature or the heat-resistant temperature can be reduced. Specifically, the heat adjuster 13 disposed among the plurality of infrared heaters 12, absorbs heat from the infrared heaters 12, to thereby prevent excessive heating of the infrared heater 12 by the other infrared heaters 12. The plurality of infrared heaters 12 and the heat adjuster 13 need not always be disposed in alignment, but may be disposed such that the heat from one of the infrared heaters 12 can be blocked by at least part of the heat adjuster 13 as illustrated in FIG. 2.

More specifically, each heater 12 is rated at 1,000 watts. When all of five heaters are lit during printing, the maximum total watt number becomes 5,000 watts. Because the heater fuses at around or more of the above maximum watt number, the heat adjuster 13 disposed in the center of the plural heaters is necessary.

In the present embodiment, the interval between adjacent heaters is 3.75 mm. The heat adjuster 13 in the form of a dummy heater glass tube includes a bossy surface due to molding process, so that the heat adjuster 13 positions slightly offset from a rigid center relative to each of the heaters 12.

In addition, although the temperature inside the heat roller 11 is different based on the output or number of infrared heaters 12, it may increase up to approximately 900 degrees C. As a result, the heat adjuster 13 may preferably be formed of quartz glass that does not blacken at 900 degrees C. and does not expand due to heat. However, the heat adjuster 13 may be formed of other glass materials or heat-resistant materials that do not blacken at such a temperature and do not expand due to heat, considering the temperature inside the heat roller 11. Other examples of glass materials include, for example, Neoseram (registered trademark), Pyrex (registered trademark), and the like. So long as the heat conductivity is low and the excessive temperature rise of the heat adjuster 13 can be suppressed, the material is not limited to glass, and other heat-resistant materials such as ceramic can be employed.

As illustrated in FIG. 2, the diameter of the heat adjuster 13 is smaller than that of the infrared heater 12; however, alternatively the diameter may be the same or larger than that of the infrared heater 12. Further, the cross-sectional shape of the heat adjuster 13 may be polygonal, and is not limited to a circular shape. For example, because five infrared heaters 12 are disposed in the present embodiment, the cross section of the heat adjuster may be hexagonal and the infrared heaters 12 may be disposed opposite each line or each point of the hexagonal shape of the heat adjuster 13. The heat adjuster 13 having a diameter of 6 mm (ϕ6) according to the present embodiment is spaced away from the glass tube surface of each of the five infrared heaters 12 by approximately four to five millimeters (4 mm ≤5 mm).

The fixing roller 14 is a cylindrical roller including a metal core that is formed of, for example, aluminum or iron; and an elastic layer formed of silicone rubber and disposed around the circumference of the metal core. The elastic layer may employ foamed silicone rubber so that the heat from the fixing belt 16 is not absorbed by the elastic layer and the warm-up time period can be reduced. In addition, the fixing roller 14 is driven to rotate by a drive unit or a cylindrical rotary member formed of a motor, gears, and the like.

The tension roller 15 is a cylindrical roller, designed to apply an appropriate tension to the fixing belt 16. Due to this appropriate tension serving as a frictional force, an internal circumference of the fixing belt 16, the heat roller 11, and an outer circumference of the fixing roller 14 are so fitted not to cause slipping.

The fixing belt 16 is an endless belt member stretched between the heat roller 11 and the fixing roller 14. The fixing belt 16 has a three-layer structure in cross-section, and includes a base formed such as nickel, stainless steel, polyimide, and the like; an elastic layer formed of silicone rubber; and a PFA (tetrafluoroethylene-perfluoroalkoxyethylene copolymer) layer disposed on the circumference of the silicone rubber layer. The fixing belt 16 is stretched around the heat roller 11 and the fixing roller 14 with a constant tension. As described above, the tension roller 15 applies such a tension to the fixing belt 16 that does not cause a slip among the inner circumferential surface of the fixing belt 16, the heat roller 11, and the outer circumferential surface of the fixing roller 14. When the fixing roller 14 is driven to rotate, the fixing belt 16 rotates and causes the heat roller 11, a driven roller, to rotate.

The pressure roller 17 is a roller to press the fixing roller 14. The pressure roller 17 is a cylindrical roller including a metal core that is formed of, for example, aluminum or iron; and an elastic layer formed of silicone rubber and disposed around the circumference of the metal core. The pressure roller 17 is rotatably disposed, and the outer circumferential surface of the pressure roller 17 is pressed against the fixing roller 14 via the fixing belt 16, to thereby pressurize the fixing roller 14. A portion pressed by the fixing roller 14 and the pressure roller 17 via the fixing belt 16 is a so-called nip portion N. Specifically, the pressure roller 17 serves as a pressing member, and the fixing roller 14 serves as a fixing member.

The inlet guide 18 is a platelet member to guide the sheet P serving as a recording medium on which an unfixed toner image T is formed, to the nip portion N, in a direction indicated by an arrow A.

The separation plate 19 serves to prevent the sheet P from winding around the fixing belt 16 or to separate the sheet P from the fixing belt 16. The stripper finger 20 serves to prevent the sheet P from winding around the pressure roller 17 or to separate the sheet P from the pressure roller 17.

The upper outlet guide 21 is a platelet member to guide the sheet P on which the toner image T has been fixed in the nip portion N, to a sheet ejection tray, and the like. The lower outlet guide 22 is a platelet member to guide the sheet P on which the toner image T has been fixed in the nip portion N, to a sheet ejection tray, and the like. The upper outlet guide 21 and the lower outlet guide 22 pass the sheet P in between to guide it to the sheet ejection tray, and the like.

The temperature sensor 23 is disposed near an outer surface of the fixing belt 16. The temperature sensor 23 senses a surface temperature of the fixing belt 16. The sensed temperature is used for controlling the infrared heater 12.

In the thus-configured fixing device 1, the surface temperature of the fixing belt 16 is sensed by the temperature sensor 23, and the infrared heater 12 is controlled such that the surface temperature of the fixing belt 16 is set to a predetermined set temperature based on the sensed temperature of the fixing belt 16. The above control is performed by controlling ON/OFF of the infrared heater 12, such that all the infrared heaters 12 are simultaneously turned on or off.

The fixing belt 16 is heated by the heat roller 11 heated by the infrared heater 12. The heated fixing belt 16 is driven to rotate by a rotary driving of the fixing roller 14.

The sheet P on which the unfixed toner image T is formed is conveyed to the fixing device 1, and passes through the nip portion N from the inlet guide 18, in which the unfixed toner image T is fused and fixed onto the sheet P. The sheet P is then sent to the sheet ejection tray, and the like, via the upper outlet guide 21 and the lower outlet guide 22.

The heat adjuster 13 formed of glass is disposed at an internal central portion of the infrared heaters 12, which are disposed around an internal circumference of the heat roller 11 of the fixing device 1. With such a configuration, the heat adjuster 13 can absorb the heat emitted from the infrared heaters 12, reduces direct influence from other infrared heaters 12 disposed opposite each infrared heater 12, and lowers a possibility that the temperature rises exceeding the rated temperature. As a result, degradation of the infrared heaters 12 due to heat can be prevented. Further, shortening of the lifetime of the infrared heaters 12 can be avoided.

The heat adjuster 13 is disposed equidistant from each of the plurality of infrared heaters 12*a*, 12*b*, 12*c*, 12*d*, and 12*e*, so that the temperature inside the heat roller 11 due to the heat emitted from each of the infrared heaters 12, can be even.

Furthermore, because the heat adjuster 13 is formed of glass with a low thermal conductivity, an excessive temperature rise of the heat adjuster 13 can be suppressed.

When the heat adjuster 13 is formed of the quartz glass with a very low thermal conductivity, the thermal expansion of the heat adjuster 13 can be suppressed, and even when the diameter of the heat roller 11 is small, the heat adjuster 13 can be disposed in a small space.

The present fixing device 1 includes a pressure roller 17, a rotary member to press the fixing roller 14 and the fixing belt 16, and the fixing roller 14 and the pressure roller 17 are pressed together via the fixing belt 16, to thereby form a nip portion N at the pressed portion. With such a structure, the fixing device employing the belt fixing system can be formed, thereby enabling to fuse and fix the unfixed toner image T even with a short warm-up time.

Figure 3:
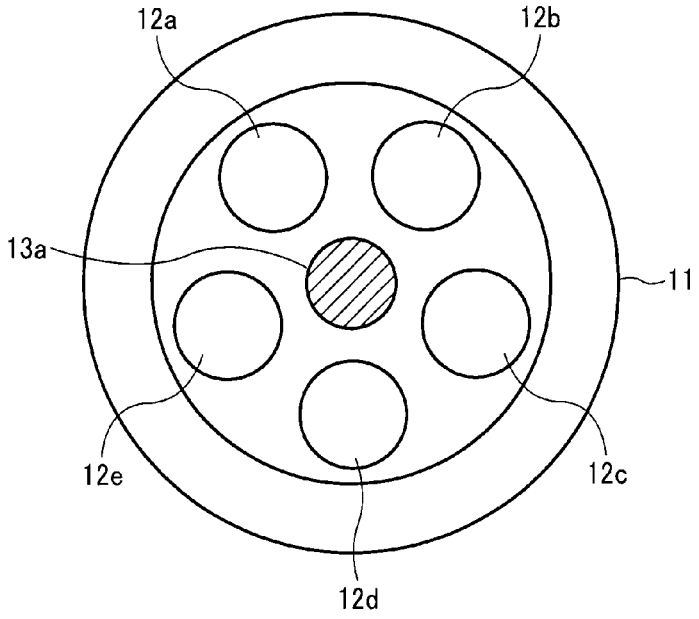
FIG. 3 is another example of the heat adjuster as illustrated in FIG. 2.

Heretofore, the heat adjuster 13 having a hollow tube has been described; alternatively, however, it may be formed of a solid bar. A heat adjuster 13*a* as illustrated in FIG. 3 includes a solid bar shape. Even with this configuration, the same effect as that of FIG. 2 can be obtained.

Figure 4:
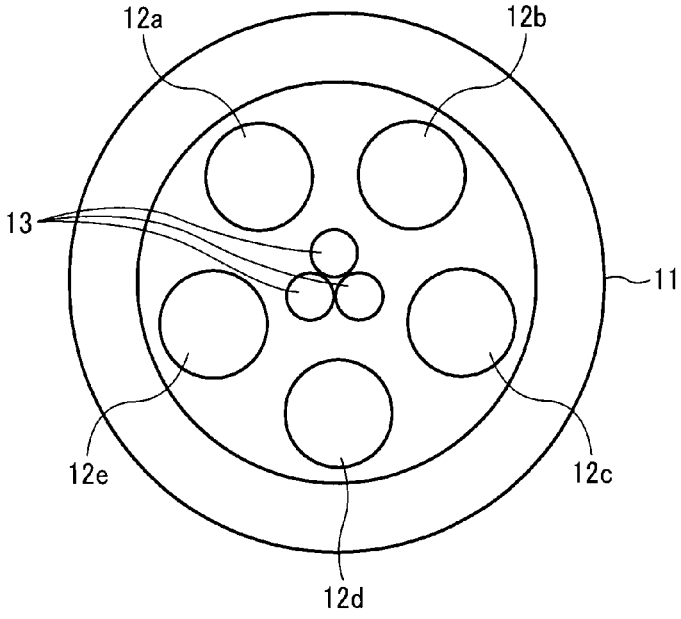
FIG. 4 is further another example of the heat adjuster as illustrated in FIG. 2.

In the example of FIG. 2, only one heat adjuster 13 is used, but a plurality of heat adjusters 13 may be used. For example, as illustrated in FIG. 4, a plurality of heat adjusters 13 is disposed at a center of the heat roller 11. The number of heat adjusters 13 is not limited to the number as exemplified in FIG. 4. In FIG. 4, three heat adjusters 13 are disposed in contact with each other in a condensed manner; however, the heat adjusters can be adjacently disposed with an equal interval relative to the cross-sectional center of the heat roller 11 and relative to each of the heat adjusters 13.

(Second Embodiment)

A fixing device 1 according to a second embodiment of the present invention will be described with reference to FIG. 5. The same reference numerals will be applied to a part which is the same as the already explained part in the first embodiment and redundant explanation thereof will be omitted.

Figure 5:
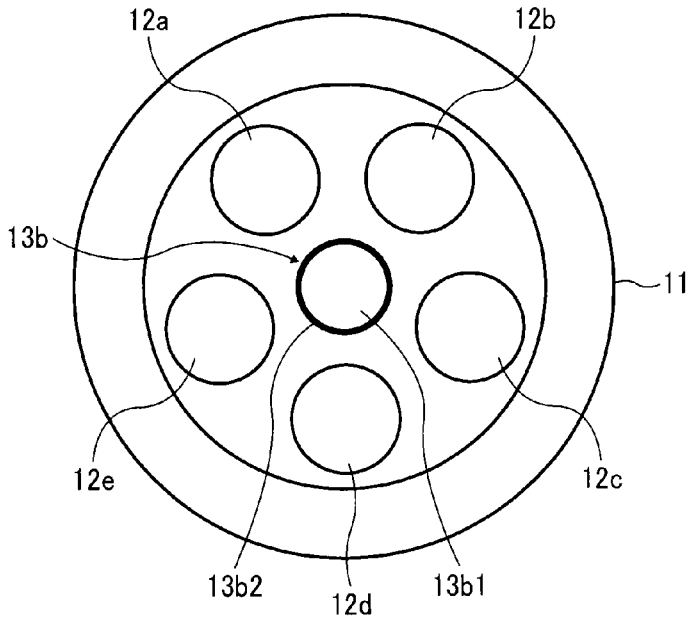
FIG. 5 schematically illustrates a fixing device according to a second embodiment of the present invention.

As illustrated in FIG. 5, a heat adjuster 13*b* is substituted for the heat adjuster 13. The heat adjuster 13*b* includes a core 13*b*1 formed of a glass tube as employed in the first embodiment, and a reflection layer 13*b*2 formed around the circumference of the core 13*b*1. Specifically, in the present embodiment, the heat adjuster 13 reflects heat from the infrared heaters 12, to thereby prevent excessive heating of one infrared heater 12 by the other infrared heater 12.

Exemplary materials of the reflection layer 13*b*2 include gold or silver capable of resist such a high temperature of approximately 900 degrees C. and reflecting heat. Depending on the degree of heat-resistant temperature, SUS (Steel Special Use Stainless) or aluminum may be used. The reflection layer 13*b*2 is formed by coating gold and the like on the glass tube.

Alternatively, the reflection layer 13*b*2 may include a concave and convex surface so as to reflect heat to the inner circumferential surface of the heat roller 11. The surface of the reflection layer 13*b*2 may be configured to diffuse light irregularly. That is, the infrared heater 12 is preferably formed not to be heated by the reflected heat.

In addition, not limited to forming the reflection layer 13*b*2, the surface of the glass tube can be subjected to a direct process such as a frosted glass treatment, so that the heat can be diffused. Alternatively, the reflection layer 13*b*2 may be a hollow tube or a solid tube formed of gold or SUS.

With such a configuration, the heat adjuster 13*b* includes the reflection layer 13*b*2 that reflects heat to the external surface, can reduce direct influence from other infrared heaters 12 disposed at opposed positions, and lowers a possibility that the temperature rises to exceed the rated temperature. As a result, degradation of the infrared heater 12 due to heat can be prevented. Further, shortening of the lifetime of the infrared heaters 12 can be avoided.

In addition, because the heat is reflected to the inner circumference of the heat roller 11, the heat absorbed by the heat adjuster 13 as illustrated in FIG. 2 can be used to heat the heat roller 11, thereby improving the heating efficiency.

In the second embodiment, the heat adjuster 13*b* may be a hollow tube or a solid bar. The cross-sectional shape of the heat adjuster 13*b* may be polygonal, not limited to a circular shape. The heat adjuster 13*b* may be formed of a plurality of tubes or bars.

(Third Embodiment)

A fixing device 1 according to a third embodiment of the present invention will be described with reference to FIG. 6. The same reference numerals will be applied to a part which is the same as the already explained part in the first and second embodiments and redundant explanation thereof will be omitted.

Figure 6:
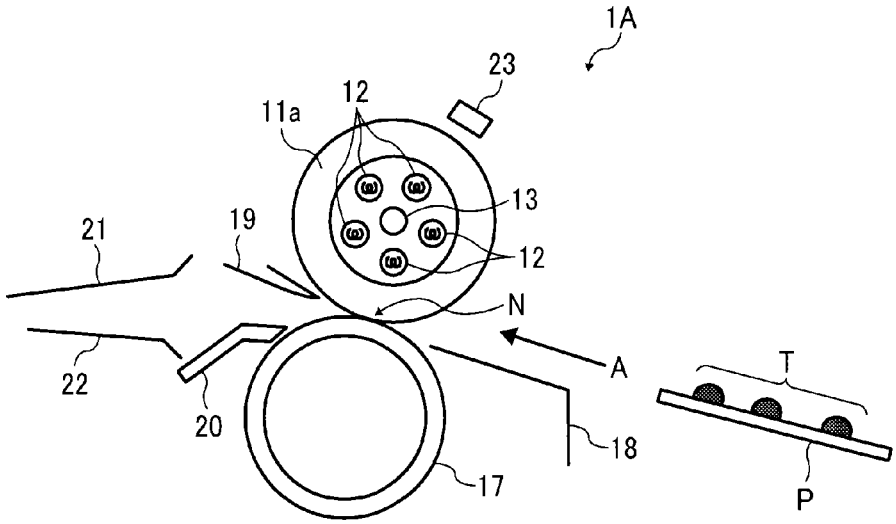
FIG. 6 schematically illustrates a heat adjuster of a fixing device according to a third embodiment of the present invention.

As illustrated in FIG. 6, a fixing device 1A according to the third embodiment includes a heat roller 11*a*, an infrared heater 12, a heat adjuster 13, a pressure roller 17, an inlet guide 18, a separation plate 19, a stripper finger 20, an upper outlet guide 21, a lower outlet guide 22, and a temperature sensor 23. Specifically, the fixing device 1A employs heat roller fixing system.

In the third embodiment, the infrared heater 12, the heat adjuster 13, the pressure roller 17, the inlet guide 18, the separation plate 19, the stripper finger 20, the upper outlet guide 21, the lower outlet guide 22, and the temperature sensor 23 are similarly configured as those in the first embodiment.

The heat roller 11*a* according to the third embodiment is formed of a cylindrical, hollow roller formed of, for example, aluminum or iron, and includes a total of five infrared heaters 12*a*, 12*b*, 12*c*, 12*d*, and 12*e* each serving as an infrared heater 12, disposed inside the heat roller 11. The heat adjuster 13 is disposed inside the heat roller 11*a*. A portion pressed by the pressure roller 17 and press-contacted by the pressure roller 17 is a so-called nip portion N. Notably, the heat roller 11 a also serves as the fixing roller 14.

As illustrated in FIG. 6, the heat adjuster 13 employed in the first embodiment is used; however, the heat adjuster 13 may be substituted by the heat adjuster 13*a* of FIG. 3 or may be substituted by the heat adjuster 13*b* as depicted in the second embodiment.

According to the third embodiment, the pressure roller 17 to press the heat roller 11*a* is included, and a nip portion is formed by the pressure roller 17 and the heat roller 11*a*. As configured as above, the heat roller fixing system can be embodied, the fixing device can be miniaturized, and the unfixed toner image T can be fused and fixed.

(Fourth Embodiment)

A fourth embodiment of the present invention will be described with reference to FIG. 7. The same reference numerals will be applied to a part, which is the same as the already explained part in the first to third embodiments, and redundant explanation thereof will be omitted.

The present embodiment is an example of image forming apparatus including the fixing device 1 or the fixing device 1A explained in the first to third embodiments.

Specifically, the image forming apparatus 200 according to the present embodiment is a tandem-type color copier. The image forming apparatus 200 is a high-speed copier including following structural parts. The image forming apparatus 200 includes an image forming section 200A, a sheet feed section 200B, and a fixing device 1.

The image forming section 200A includes a transfer belt 210 that includes a transfer surface extending in the horizontal direction and has a structure to form an image of a color having a complementary color relation with a color-separated color on an upper surface thereof. Photoconductors 205Y, 205M, 205C, and 205K capable of carrying an image by a color of toner (yellow, magenta, cyan, or black) having a relation of complementary color are disposed along the transfer surface of the transfer belt 210.

Each photoconductor 205Y, 205M, 205C, or 205K includes a drum that rotates in a counterclockwise direction similarly. (Hereinafter, Y-color is used as representative for simplification of the description.) Each photoconductor 205Y includes an optical writing device 201 (disposed at two positions in the present embodiment), a charger 202Y, and a developing device 203Y Each photoconductor 205Y further includes a primary transfer device 204Y and is disposed as illustrated in FIG. 7. Each developing device 203 accommodates toner of respective colors.

The transfer belt 210 is stretched around a drive roller and a driven roller, and is configured to rotate in the same direction at a position opposed to each photoconductor 205Y, 205M, 205C, or 205K. A transfer roller 212 is disposed at a position opposed to all opposite roller 211, one of the driven rollers. A conveyance path of the sheet P from the transfer roller 212 to the fixing device 1 is along a horizontal direction.

The sheet feed section 200B includes a paper tray 220 to contain multiple sheets P each as a recording medium stacked thereon; and a conveyance structure to separate each sheet one by one from the top of the sheets stacked inside the paper tray 220, to convey it to the transfer roller 212.

Concerning image formation performed in the image forming apparatus 200, a surface of the photoconductor 205Y is evenly charged by the charger 202Y and an electrostatic latent image is formed on the photoconductor 205Y based on image information sent from an image reader. The electrostatic latent image is rendered visible as one-color toner image by the developing device 203Y accommodating yellow toner, and the thus-formed toner image is primarily transferred on the transfer belt 210 by a primary transfer device 204Y that applies a predetermined amount of bias voltage. Other photoconductors 205M, 205C, and 205K perform image formation similarly to the photoconductor 205Y employing different color of toner, and the toner images of respective colors are sequentially overlaid on the transfer belt 210 electrostatically.

Subsequently, the toner image that has been primarily transferred from each photoconductor 205 to the transfer belt 210, is transferred to the sheet P that has been conveyed thereto by the opposite roller 211 and the transfer roller 212. The sheet P onto which the toiler image has been transferred, is further conveyed to the fixing device 1, and the toner image on the sheet P passed through a fixing nip N formed between the fixing belt 16 and the pressure roller 17, so that the toner image on the sheet P is fixed onto the sheet P. The sheet P ejected from the fixing device 1 is discharged to a sheet ejection tray 215 along a sheet discharge path.

According to the present embodiment, degradation, due to heat, of the heating means such as the infrared heaters for use in the fixing device 1 included in the image forming apparatus 200, can be prevented. As a result, shortening of the lifetime of the infrared heaters 12 can be avoided, and the maintenance cost rise due to replacement of the parts can be suppressed.

Figure 7:
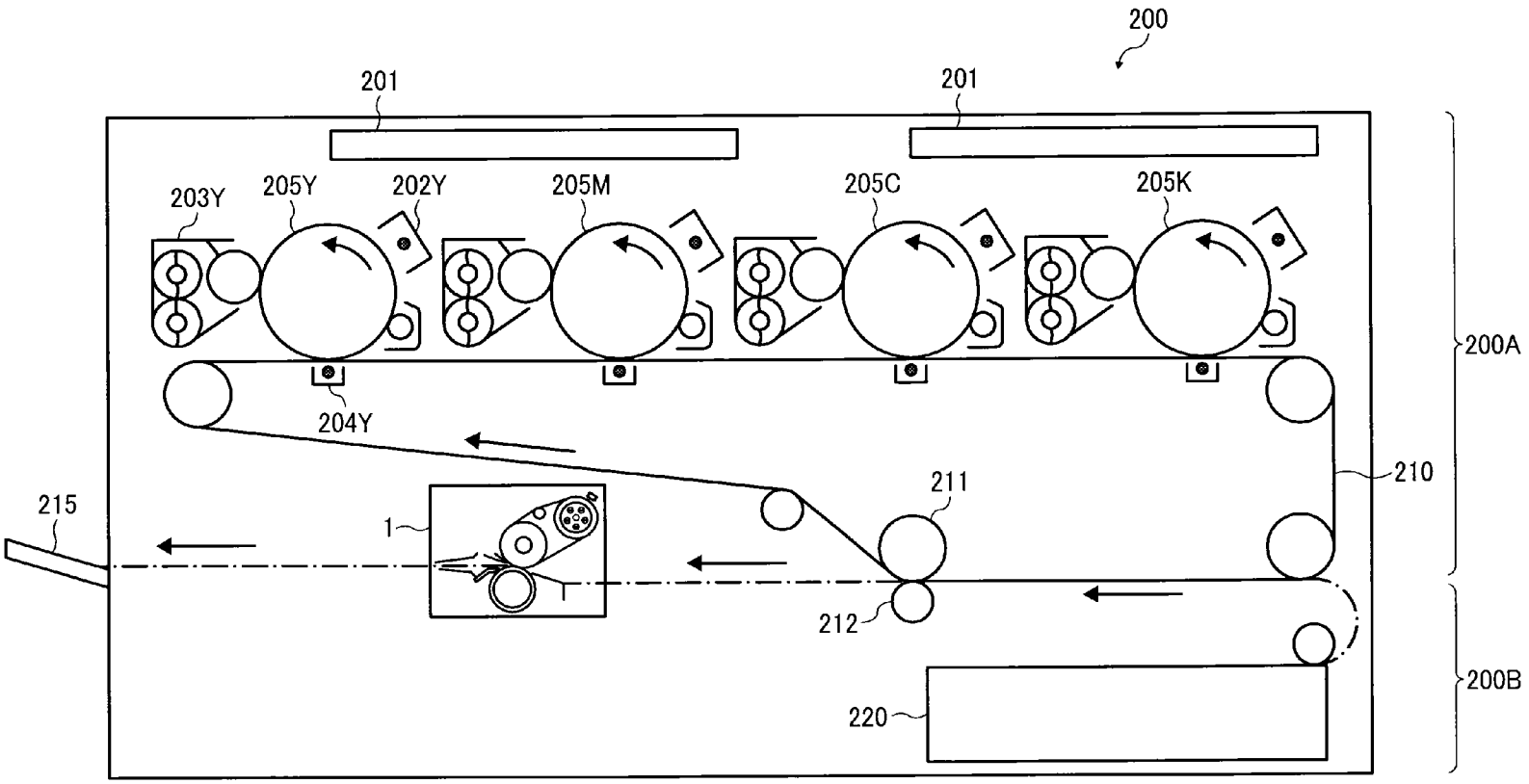
FIG. 7 schematically illustrates an image forming apparatus according to a fourth embodiment of the present invention.

Although the fixing device 1 as illustrated in FIG. 7 is used as an exemplary embodiment, the fixing device 1*a* as illustrated in FIG. 6 is equally used.

As the image forming apparatus, a color copier has been described heretofore, but the present embodiment can be applied to printers, facsimile machines, and other types of image forming apparatuses, so long as the image forming apparatus employs a fixing device to fix an image to the recording medium such as a sheet using effects of heat.

The structure of the present invention is not limited only to the above embodiment. Instead, engineers who belong to the subject art field can appropriately modify the embodiments variously within a scope of the present invention. Such modifications fall within the scope of the present invention so long as the configuration and structure of the present fixing device and of the image forming apparatus are fulfilled.

Additional modifications and variations of the present invention are possible in light of the above teachings. It is therefore to be understood that, within the scope of the appended claims, the invention may be practiced other than as specifically described herein.

What is claimed is:

1. A fixing device comprising:

a cylindrical heat roller;

a plurality of heaters including at least three heaters disposed inside the heat roller, extending along a longitudinal axis of the heat roller; and a heat adjuster, disposed among the plurality of heaters, to absorb heat from one to another of the plurality of heaters, the heat adjuster including a curved surface facing at least some of said heaters.

2. The fixing device as claimed in claim 1, wherein the heat adjuster is disposed equidistant from each of the plurality of heaters.

3. The fixing device as claimed in claim 1, wherein the plurality of heaters is disposed equidistantly around an inner circumference of the heat roller, and the heat adjuster is disposed at an internal central portion of the heat roller.

4. The fixing device as claimed in claim 1, wherein the heat adjuster is formed of glass.

5. The fixing device as claimed in claim 4, wherein the heat adjuster is formed of quartz glass.

6. The fixing device as claimed in claim 1, wherein the heat adjuster reflects heat from the plurality of heaters.

7. The fixing device as claimed in claim 1, wherein the heat adjuster comprises a reflection layer around a circumference thereof.

8. The fixing device as claimed in claim 1, comprising:

a fixing roller;

a belt rotatably stretched around the heat roller and the fixing roller; and a pressure roller to press against the fixing roller via the belt, wherein the pressure roller, and the belt pressed by the pressure roller form a nip portion.

9. The fixing device as claimed in claim 1, further comprising a pressure roller to press against the heat roller, wherein the pressure roller and the heat roller form a nip portion.

10. The fixing device as claimed in claim 1, wherein a total rated power of the plurality of heaters sums up to 5,000 watts or greater.

11. An image forming apparatus comprising the fixing device as claimed in claim 1.

12. An image forming apparatus comprising:

an image forming section to form an image on a recording medium; and the fixing device as claimed in claim 1, to fix the image onto the recording medium.

13. The fixing device as claimed in claim 1, further comprising a pressure roller to press against the heat roller and wherein the heat adjuster is cylindrical, wherein the pressure roller and the heat roller form a nip portion.

14. A fixing device comprising:

a cylindrical heat roller;

a plurality of heaters disposed inside the heat roller, extending along a longitudinal axis of the heat roller; and a heat adjuster, disposed among the plurality of heaters, to adjust heat from one to another of the plurality of heaters, the heat adjuster comprising glass.

15. The fixing device as claimed in claim 14, wherein the heat adjuster comprises quartz glass.

16. The fixing device as claimed in claim 14, wherein the heat adjuster reflects heat from the plurality of heaters.

17. The fixing device as claimed in claim 14, wherein the heat adjuster comprises a reflection layer around a circumference thereof.

18. The fixing device as claimed in claim 14, comprising:

a fixing roller;

a belt rotatably stretched around the heat roller and the fixing roller; and a pressure roller to press against the fixing roller via the belt, wherein the pressure roller, and the belt pressed by the pressure roller form a nip portion.

19. An image forming apparatus comprising:

an image forming section to form an image on a recording medium; and the fixing device as claimed in claim 14, to fix the image onto the recording medium.

20. A fixing device comprising:

a cylindrical heat roller;

a plurality of heaters including at least three heaters disposed inside the heat roller, extending along a longitudinal axis of the heat roller; and a heat adjuster, disposed among the plurality of heaters, to absorb heat from one to another of the plurality of heaters, the heat adjuster having a polygonal shape bounded by five or more line segments.

* * * * *